United States Patent [19]

Himmelrich

[11] 4,076,101

[45] Feb. 28, 1978

[54] UTILITY COAT WITH SEATING HARNESS

[76] Inventor: Lew Himmelrich, 32742 Alipaz St., San Juan Capistrano, Calif. 92675

[21] Appl. No.: 740,096

[22] Filed: Nov. 9, 1976

[51] Int. Cl.[2] ..... A62B 35/00

[52] U.S. Cl. ..... 182/3

[58] Field of Search ..... 182/3, 4, 5, 6, 7, 8, 182/129; 2/93, 94

[56] References Cited

U.S. PATENT DOCUMENTS

| | | | |
|---|---|---|---|
| 1,298,615 | 3/1919 | Wilkinson | 182/3 |
| 3,498,408 | 3/1970 | Foote | 182/6 |
| 3,973,643 | 8/1976 | Hutchinson | 182/3 |

*Primary Examiner*—Reinaldo P. Machado
*Attorney, Agent, or Firm*—Wills, Green & Mueth Law Corporation

[57] ABSTRACT

A utility coat having a body portion with a central vertical front opening and engageable about the torso of a wearer, and a belt fixed to and extending about the exterior of said body portion and engageable about the midriff of the wearer's torso, said belt having flexible free end portions adjacent opposite sides of said opening. A pair of elongate flexible crotch straps are provided within said body portion, said straps having rear ends fixed to the belt at opposite rear quarters thereof and having front end portions with belt engaging loops. The front and rear end portions of said straps are releasably secured together within said body portion rearward of the wearer's torso when not in use, the front ends being releasable and movable under the wearer's crotch with the ends of the belt extending through the loops on the straps, whereby belt and straps establish a seating harness for the wearer. Means are provided to releasably couple the free ends of the belt together and with a descent control device which is stored in a pocket in the coat.

7 Claims, 4 Drawing Figures

UTILITY COAT WITH SEATING HARNESS

BACKGROUND AND BRIEF SUMMARY OF THE INVENTION

This invention relates generally to an improved coat structure and is more particularly concerned with such a garment which includes means to establish a boatswain's sling or seating harness for use in combination with a line and descent control device.

The prior art has provided special wearing apparel which is intended to afford men working under hazardous conditions with a reasonable degree of protection, and which oftentimes provides means to impart special utilitarian functions to the apparel which is not found in ordinary wearing apparel.

One item of special wearing apparel which the prior art provides is a fireman's turn-out coat. This special form of coat is a loose fitting garment of tough, durable, water-proof fabric and has a loosely fitted inner liner of soft, heat insulating material.

Firemen's coats of the character referred to above are normally mid-length coats, extending from the wearer's shoulders to near the middle of his upper legs or thighs. These coats open centrally and vertically at the front and are provided with vertically-spaced spring-hook and eye type releasable fastening means. Finally, such firemen's coats may be provided with belts engaged about their exterior to occur at or about the waist of the wearer and which are permanently fixed to the coat, as by stitching. The waist belts have flexible, opposite free end portions of limited longitudinal extent at opposite edges of the open front of the coats and which may be provided with freely accessible retaining or buckling rings.

The normal, intended use of the above noted belts and rings is to enable the firemen wearing the coats to releasably secure themselves to the fire truck while enroute to a fire, by engaging the rings to anchoring hooks fixed to the fire trucks.

Use of the above noted special utility coat is not limited to firemen, but is widely used by men engaged in various emergency services and rescue operations.

In the course of fighting fires and in other rescue and/or repair operations, it is not infrequent that the men must escape from elevated, hazardous locations by means of descent lines.

In view of the above, the prior art has provided various special descent control tackle which, when necessary, can be brought into use. An important part of such tackle is a body engaging harness which engages with and about appropriate portions of a man's body and with which other means and parts of the tackle are cooperatively related.

The above noted harness means provided by the prior art are, as a general rule, rather heavy, large or bulky structures of broad belting material with large and heavy metal pieces of hardward fixed thereto. Such harness means are such that they cannot be practically and effectively provided for each man and carried about by him, as a part of his personal survival equipment.

On numerous occasions, firemen have been trapped in elevated locations from which they could have escaped if provided with suitable descent tackle.

In efforts to overcome the problems noted above, the prior art has sought to provide firemen and the like with personal equipment which will enable them to effect their own escape from heights, when necessary. To date, one of the most satisfactory of such devices comprises a small diameter, lightweight yet strong rope and a descent control device mounted thereon. This descent control device is manufactured and sold under the trademark SKY-GENIE by Descent Control Inc., at Costa Mesa, California, and is fully described in U.S. Pat. No. 3,250,515, issued May 10, 1966.

While the aforesaid descent control device has proven to be most satisfactory in operation, one of the problems during emergency situations, is the absence of an appropriate harness which would be safe and yet comfortable. One expedient used by firemen is to couple the SKY GENIE descent control device to the belt of his turn-out coat. However, coupling the above noted descent control device to the belt, not only concentrates forces about a man's torso or midriff in an undesirable and dangerous manner, but directs and concentrates those forces in an unbalancing manner which is such that a man is likely to be left with little or no control of direction and/or body disposition.

Accordingly, one object of the present invention is to provide a utility coat of the general character referred to above with a seating harness incorporated therein, whereby a man wearing the coat and equipped with descent tackle can conveniently couple the tackle with the harness of his coat for safe, controlled descent of his person through use of said tackle.

More particularly, it is an object to provide such harness means in a coat, which includes a pair of crotch straps with upper rear ends secured to a belt fixed about the waist portion of the jacket, intermediate lower crotch engaging portions and upper front ends with loops and having means to selectively couple said front ends or front end portions with the center front portion of the belt.

Another object is to provide such harness means wherein the upper front end of the crotch straps are normally positioned adjacent the upper rear ends of said straps and are releasably secured thereto, whereby the straps normally depend from the belt at the rear of the jacket in a single fold and are readily manually accessible from between the wearer's legs for extending them through the wearer's crotch and coupling their front ends with the belt at the front of the jacket.

Yet another object is to provide such an improved utility coat wherein the belt is split or opens at the front of the coat and is provided with flexible free end portions of limited longitudinal extent and carrying retainer or buckling rings, and wherein the upper front ends of the straps define loops through which related free end portions of the belt can be freely slidably engaged to secure those ends of the straps to the belt.

A further object is to provide suitable coupling means for releasably securing the retainer or buckle rings of the belt together and for coupling the belt with a cooperating descent control device.

DESCRIPTION OF A PREFERRED EMBODIMENT OF THE INVENTION

Figure 1:
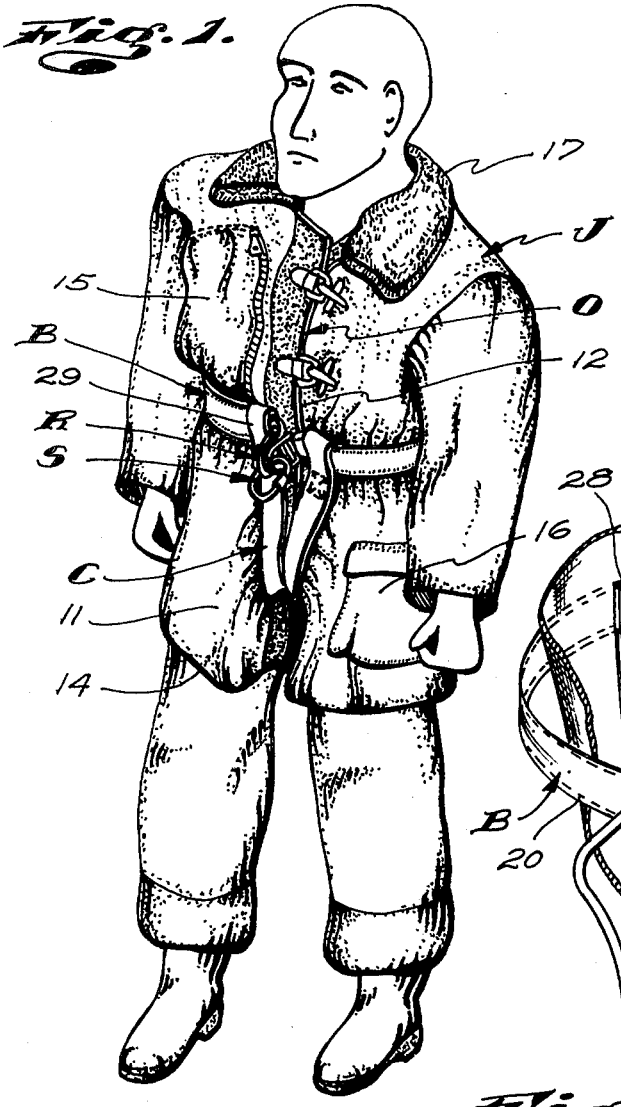
FIG. 1 is a perspective view of a fireman wearing a turn-out coat embodying my invention.

Referring to the drawings, the invention that I provide includes a suitable utility coat or jacket J, such as a fireman's turn-out coat, comprising a torso-enveloping body portion, an upper shoulder covering portion with a neck opening and sleeves, all of which parts and/or portions are related one to the other in the manner of a conventional coat or jacket.

The torso enveloping body portion of the coat can be characterized as having a rear panel 10, a pair of laterally spaced front panels 11 with inner vertical opposing edges 12 and defining a central vertically extending split or opening O. The lower end of the body section terminates at a lower or bottom edge 14. The body portion is made from suitable, flexible fabric and is divisible into an upper portion which occurs about the upper torso or chest of the wearer and joins with the shoulder covering portion and sleeves of the coat, a central portion which occurs about the waist or midriff portion of the wearer and a lower skirt portion which occurs about the lower torso, buttocks and thighs of the wearer.

In the preferred embodiment of the invention, the coat is provided with one or more pockets 15 and 16, a suitable collar 17 about the aforementioned neck opening, releasable fastening means F for securing the opening O closed, and a liner L within the body portion of the coat. Insofar as the instant invention is concerned, the only parts or portions of the coat or jacket J which are directly structurally related to the present invention are the intermediate waist and the lower skirt portion of the jacket and the portions of the liner L which are related to the noted portions of the coat.

The first element or part of the present invention is a belt B engaged about the exterior of the waist portion of the body portion of the coat and fixed thereto as by stitching 20 to form an integral part of the coat. The belt B is open at its front adjacent the opening O of the jacket, and has flexible free end portions 21 of limited longitudinal extent. The free end portions are folded and stitched to establish loops which are engaged through and retain large metal buckling rings R. The rings R are normally adapted to releasably engage with anchoring hooks or the like (not shown) on fire-fighting or rescue trucks and the like, to secure the wearer of the coat to the truck during movement of the vehicle.

The belt B, while referred to above as the first part or element of my invention, is in fact a standard or conventional part of the type or class of utility coat or jacket which is here provided and is not to be considered as a new and special element or part which is required to be added in carrying out my invention. It will be apparent, however, that if one should desire to incorporate the present invention with a common coat structure which does not already include an integrated belt such as described above, such a belt would have to be added as a special part.

The present invention next includes a pair of laterally spaced, elongate, flexible, substantially vertically-extending, U-shaped or folded crotch straps C with upper rear ends 25, upper front ends 26 and central, lower, crotch-engaging portions 27.

Figure 3:
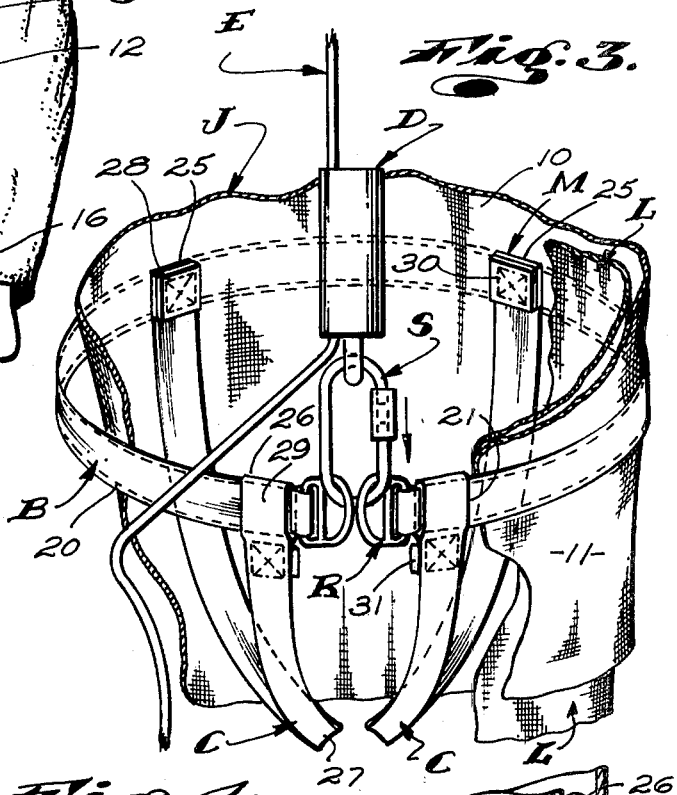
FIG. 3 is an isometric view of a portion of said coat, with portions broken away to better illustrate the invention and with a descent control device shown therewith.
Figure 2:
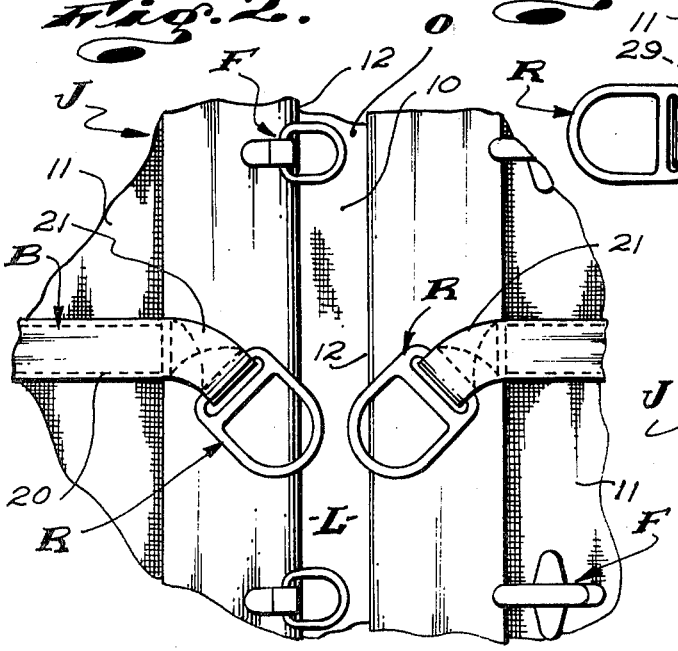
FIG. 2 is an enlarged, fragmentary view of the front portion of the coat shown in FIG. 1, with the coat in a partially open position.
Figure 4:
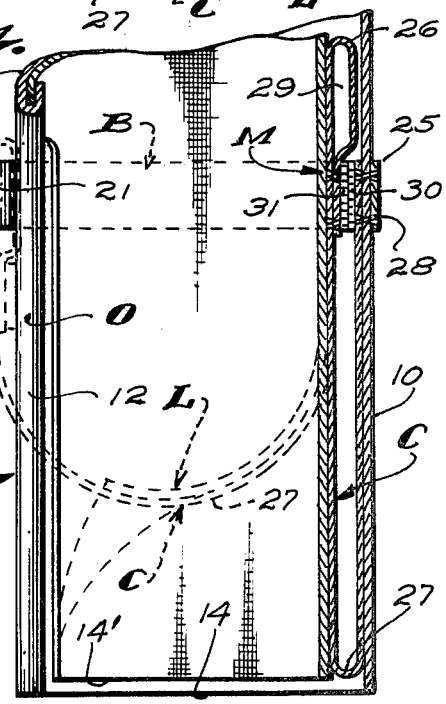
FIG. 4 is a vertical sectional view of a portion of the coat, showing the crotch straps in the inoperative position in solid lines, and in the operative position in broken lines.

The upper rear ends of the two straps C are spaced laterally apart and extend vertically at the interior of the rear panel 11 of the coat, to occur at the opposite rear quarters of the coat, and are fixed to the panel and the belt as by through stitching 28 (see FIGS. 3 and 4 of the drawings).

The upper front ends 26 of the straps are folded and stitched to establish loops 29, through which the buckle rings R and their related end portions 21 of the belt B can be easily and conveniently manually engaged, as shown in solid lines in FIGS. 1 and 3 of the drawings and in broken lines in FIG. 5 of the drawings.

In the inoperative position, the upper front ends 26 are normally moved rearward to occur adjacent the upper rear end portions of the straps. The upper adjacent ends of said end portions of the straps are releasably secured together by fastening means M, which means can be in the form of metal or plastic snap fasteners such as are commonly employed in wearing apparel or which can, as indicated in the drawings, be that form of releasable fastening means comprising fabric patches 30 and 31 with opposing inter-locking loop and cut loop pile, and which is sold under the trademark "VELCRO." In this form of fastening means, the cut pile of one patch establishes hooks which engage the eye-like loops of the uncut pile of the other patch.

In the case illustrated, the patches 30 are arranged adjacent the area of joinder between the belt and the upper rear portions of the straps and are stitched thereto by the above noted stitching 28. The patches 31 are fixed to the upper forward end portions of the straps at locations longitudinally of the straps so that the lower folded, central portions of the straps are normally held up and above the lower edge 14 of the jacket, as clearly illustrated in FIG. 4 of the drawings.

With the structure thus far described, it will be apparent that the straps C, when not in use, are normally held in a flat, vertically-extending, folded condition, adjacent the inner rear surface of the coat, where they are out of the way and are obscured from view. When thus positioned, the straps, while obscured, are easily and conveniently positioned to be manually engaged by the wearer of the jacket by simply bending over and reaching the straps from between his legs. It will be further apparent that upon engaging the straps in the above manner, the wearer can easily pull the fastening means M free, draw the released upper forward portions of the straps and the central crotch engaging portions thereof between his legs and upwardly through the open front O of the coat and engage the rings and end portions 21 of the belt through the loops 29 at the ends of the straps. Still further, when the straps are thus engaged with the belt, the lower central crotch portion of the straps are drawn between and upward into appropriate supporting engagement in the wearer's crotch and that upon closing the belt B, an effective, comfortable and safe boatswain's sling-type seating harness is established for the wearer of the coat.

It is to be noted that the seating harness thus established need not be substantially form-fitting or tightly and snugly engaged with and about the wearer as is the case with conventional seating harnesses. Rather, it can be rather loose and free fitting since the related fabric of the coat and the liner L, which will hereinafter be described, serve as web-like members cooperating with the harness to retain the wearer's body in desired engagement within the harness.

The belt and particularly the straps can be established of wide, though light-weight and highly flexible fabric webbing. As a result, the harness structure herein provided is extremely light and occupies little discernible space when in or out of use.

Finally, the structure that I provide includes means for buckling and/or closing the front of the belt when the straps C are engaged therewith and so as to close the harness and prevent the belt and straps from becoming disengaged.

In the preferred employment of the invention, when the garment is a fireman's turn-out coat such as earlier described, and the ends of the belt are provided with non-interlocking buckling or retaining rings R, I provide a large snap-ring or carabiner S, which comprises an oval ring with an opening or port in one side and a shiftable spring loaded sleeve or link normally bridging the port and shiftable to allow or permit engagement of the rings R therethrough. The snap-ring S can be advantageously employed to engage with a descent control device, such as the previously noted SKY GENIE device.

In FIG. 3 of the drawings, I have illustrated a descent control device D with a descent line E cooperating therewith and coupled with the rings R by the snap-ring S. In practice, the snap-ring S can be made a part of the descent control device and stored therewith in the upper pocket 15.

The liner L of the coat or jacket J can be a loose-fitting, removable liner of heat insulating material which is coextensive with the interior of the body and shoulder portions of the coat. The lower edge 14' of the liner is free or unsecured. The rear portion of the liner normally covers the straps C when they are in the inoperative position, that is, the straps C normally occur between the rear portion or panel of the liner and the rear panel 11 of the coat and are therefore freely accessible at and between the lower free or unsecured edges 14 and 14' of the coat and liner, as clearly shown in FIG. 4 of the drawings.

When the straps C are shifted to their operative or working position, the lower rear portion of the liner L is free to shift and to be drawn upwardly therewith and serves to pad and support the body of the wearer, as clearly illustrated in dotted lines in FIG. 4 of the drawings. It is to be particularly noted that operation and use of my invention is not dependent upon the liner L and that in practice, the liner L can be eliminated without adverse effect.

In practice, the ordinary fireman's turn-out coat may be provided with a large pouch-like pocket 15 in which a smoke mask may be stored. As previously mentioned, the above noted descent control device D, with its related line E and snap-ring can be conveniently stored in the pocket 15 of the coat J.

Having described only a typical preferred form and application of my invention, I do not wish to be limited to the specific details herein set forth, but wish to reserve to myself any modifications and/or variations that may appear to those skilled in the art and which fall within the scope of the following claims:

I claim:

1. A utility coat, comprising, in combination:

a tubular body portion with a lower edge, engageable about the torso and upper portions of a wearer's legs and including a rear panel and front panels having front edges which define a vertically-extending front opening;

an elongate, flexible belt fixed to the outside of said body portion to occur adjacent the midriff of the wearer's body and having free end portions carrying fastening means which extend to adjacent the front opening;

a pair of elongate, flexible crotch straps within the body portion having rear ends fixed to the belt at the rear panel in laterally spaced-apart relationship, and forward ends with belt-coupling means, and means for releasably securing the forward ends of the crotch straps within the body portion adjacent the rear panel in a folded relationship, the forward ends of said crotch straps being shiftable from the folded position, forwardly between a wearers legs, through the front opening, and into coupling engagement with the free end portions of the belt.

2. A utility coat as set forth in claim 1, in which the crotch straps are positioned above the lower edge of the body portion of the coat when in the folded position.

3. A utility coat as set forth in claim 1, in which the fastening means at the free end portions of the belt comprise buckle rings.

4. A utility coat as set forth in claim 3, in which the belt-coupling means at the forward ends of the crotch straps comprise loops of a size to have the buckle rings pass therethrough.

5. A utility coat as set forth in claim 1, in which the belt is fixed to the exterior of the body portion, the fastening means at the free end portions of the belt comprise buckle rings, and the belt-coupling means at the forward ends of the crotch straps comprise loops of a size to have the buckle rings pass therethrough.

6. A utility coat as set forth in claim 1, further including a liner loosely fitted in said body portion and having an unsecured lower edge spaced below the belt and above the lower edge of the body portion, the rear ends of the crotch straps being fastened to the belt between the liner and the rear panel of the body portion, whereby said crotch straps are disposed between said liner and rear panel when in the folded position.

7. A utility coat as set forth in claim 5, further including a pocket in the body portion; and a descent control device stored in said pocket, said device including a link releasably engageable with the buckle rings at the free end portions of the belt.

* * * * *